US011136886B1

(12) United States Patent
Helming

(10) Patent No.: US 11,136,886 B1
(45) Date of Patent: Oct. 5, 2021

(54) TUNNEL BORING SYSTEM

(71) Applicant: EarthGrid PBC, Berkeley, CA (US)

(72) Inventor: Troy Anthony Helming, Oakland, CA (US)

(73) Assignee: EarthGrid PBC, Berkeley, CA (US)

( * ) Notice: Subject to any disclaimer, the term of this patent is extended or adjusted under 35 U.S.C. 154(b) by 0 days.

(21) Appl. No.: 17/248,177

(22) Filed: Jan. 12, 2021

(51) Int. Cl.

| | |
|---|---|
| ***E21B 7/14*** | (2006.01) |
| ***E21B 7/18*** | (2006.01) |
| ***E21D 9/10*** | (2006.01) |
| ***E21D 9/13*** | (2006.01) |

(52) U.S. Cl.
CPC ..... *E21D 9/1073* (2013.01); *E21B 7/14* (2013.01); *E21B 7/18* (2013.01); *E21D 9/1066* (2013.01); *E21D 9/13* (2013.01)

(58) Field of Classification Search
CPC . E21B 7/14; E21B 7/18; E21D 9/1073; E21D 9/1066
See application file for complete search history.

(56) References Cited

U.S. PATENT DOCUMENTS

| | | | | |
|---|---|---|---|---|
| 3,467,206 | A | 9/1969 | Acheson et al. | |
| 3,840,270 | A | 10/1974 | Allgood | |
| 5,771,984 | A | 6/1998 | Potter et al. | |
| 5,879,057 | A * | 3/1999 | Schwoebel | E21C 25/60 299/17 |
| 2011/0120771 | A1 | 5/2011 | Montaron | |
| 2014/0008124 | A1 | 1/2014 | Ma | |
| 2014/0008968 | A1 | 1/2014 | Moeny | |
| 2014/0231398 | A1 | 8/2014 | Land et al. | |
| 2016/0024849 | A1 | 1/2016 | Kocis et al. | |
| 2017/0204669 | A1 | 7/2017 | Lehr et al. | |
| 2019/0085688 | A1 * | 3/2019 | Helming | E21B 4/16 |
| 2019/0240770 | A1 * | 8/2019 | Faircloth | B23K 37/0294 |

FOREIGN PATENT DOCUMENTS

| | | | |
|---|---|---|---|
| GB | 1446464 | A | 8/1976 |
| WO | WO 98/07960 | A1 * | 2/1998 |

OTHER PUBLICATIONS

Emory Industrial Services, "Duct and Pipe" Flyer, 1 page.
Rispin, Michael et al., "Robotic Shotcrete Applications for Mining and Tunneling", Shotcrete, Summer 2005, retrieved from Internet: https://shotcrete.org/wp-content/uploads/2020/01/2005Sum_Rispinetal.pdf, Aug. 17, 2021, 6 pages.
KPM Industries, "SPM 307 (Robotic Nozzle Manipulator)", King Shotcrete Solutions, retrieved from Internet: https://www.kpmindustries.com/KingShotcreteSolutions/product/spm-307-robotic-nozzle-manipulator/, Aug. 17, 2021, 3 pages.
(Continued)

*Primary Examiner* — Sunil Singh
(74) *Attorney, Agent, or Firm* — Nicholson De Vos Webster & Elliott LLP; Judith Szepesi

(57) ABSTRACT

A plasma tunnel boring machine including a plurality of plasma torches on the cutting head, and a plurality of nozzles on the cutting head to provide a stream to cool an area while the plasma torches are active, and a tractor providing propulsion to the cutting head, the tractor to move the cutting head to cut a tunnel.

21 Claims, 11 Drawing Sheets

(56) References Cited

OTHER PUBLICATIONS

Unknown, "Robotic Shotcrete Applications for Mining and Tunneling", Shotcrete, Fall 2018, retrieved from Internet: https://tunnelingonline.com/towards-automated-concrete-spraying/, Aug. 17, 2021, 6 pages.
Unknown, "Case Study: Vacuum calibration sleeve", retrieved from Internet: https://www.metal-am.com/introduction-to-metal-additive-manufacturing-and-3d-printing/case-study-vacuum-calibration-sleeve/, Aug. 17, 2021, 2 pages.
Reed, "Reed Shotcrete Pump used with a robotic shotcrete arm", retrieved from Internet: https://www.reedpumps.com/mineandtunnelsupportandwalls.htm, Aug. 17, 2021, 6 pages.
AMV AS, AMV 6400 Shotcrete Robot:, retrieved from Internet: https://www.amv-as.no/6400-shotcrete-robot, Aug. 17, 2021, 2 pages.
Reed, "Reed C Series Concrete & Shotcrete Pumps", retrieved from Internet: https://www.reedpumps.com/pdf/cseriesengt3121118.pdf, Aug. 17, 2021, 2 pages.

* cited by examiner

TUNNEL BORING SYSTEM

FIELD

The present invention relates to boring, and more particularly to utilizing plasma torches for tunnel boring.

BACKGROUND

Tunnel boring machines, also referred to as "moles," are used to excavate tunnels with a circular cross section through various rock and soil strata. Modern tunnel boring machines typically use a rotating cutting wheel, or cutter head, followed by a main bearing, a thrust system, and trailing support mechanisms. However, existing tunnel boring machines are large, slow, labor-intensive, and expensive. They are also extremely difficult to move between locations. The cost of operations is also significant.

BRIEF DESCRIPTION OF THE FIGURES

The present invention is illustrated by way of example, and not by way of limitation, in the figures of the accompanying drawings and in which like reference numerals refer to similar elements and in which.

DETAILED DESCRIPTION

Figure 1:
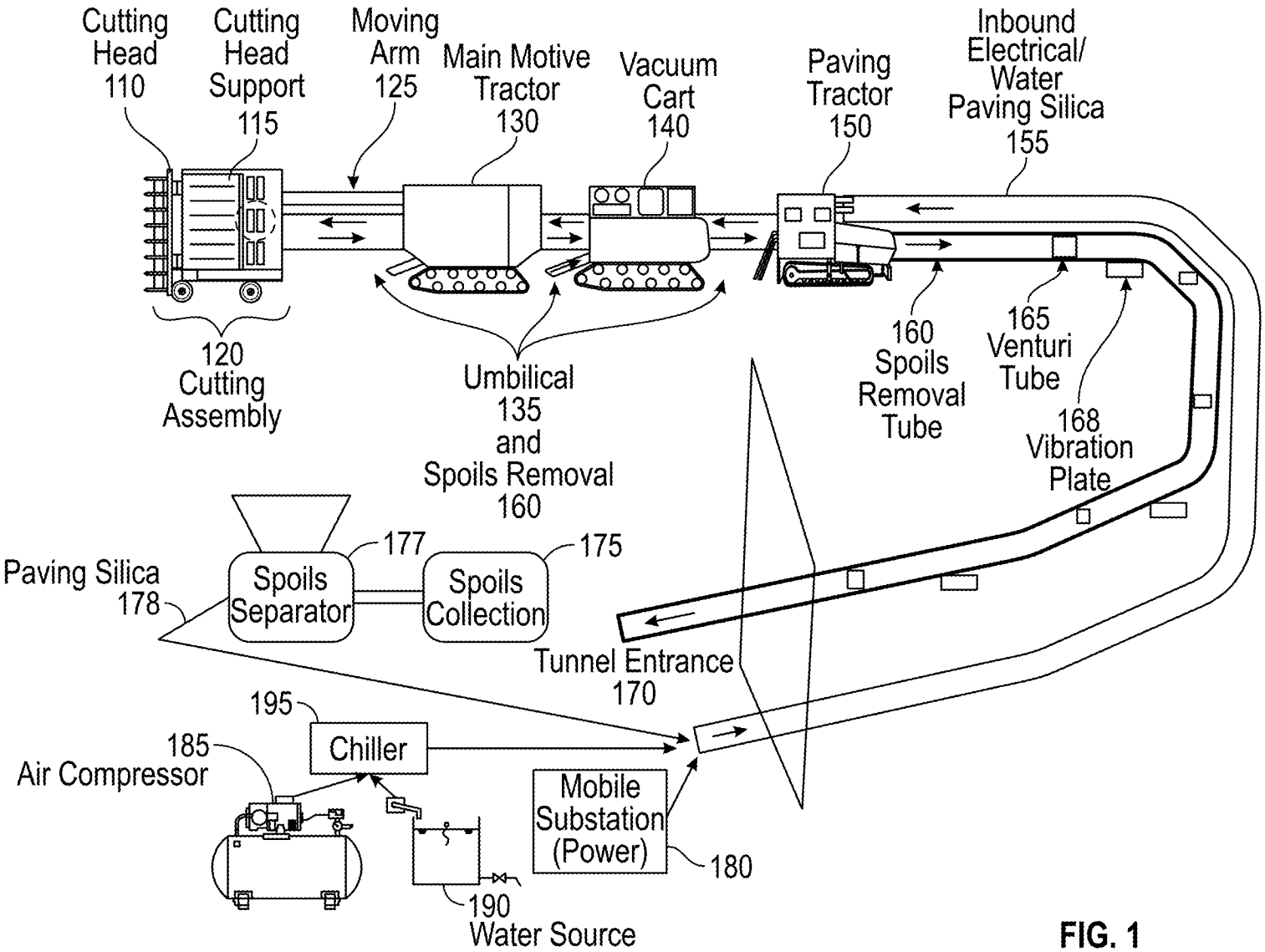
FIG. 1 illustrates one embodiment of a tunnel boring system.

A tunnel boring system (TBS) using plasma torches is described. In one embodiment, the tunnel boring system has three parts: a tractor that provides movement for the TBS, a cutting head at the front of the TBS, and a disposal portion which takes the spoils and removes them.

In one embodiment, the tractor operates as a separate unit, located approximately 2-4 meters behind the cutting head. In one embodiment, the tractor pushes the cutting head with a metal rod or rods. In another embodiment, the cutting head is connected to the tractor via a shovel assembly with two arms connecting the cutting head to the tractor. In one embodiment, the arms allow the cutting head to be raised and lowered similar to how a tractor could raise and lower its shovel bucket. In one embodiment, these elements may be constructed using off-the-shelf designs and materials.

The tractor contains propulsion, sensors, guidance and intelligence, and the balance of plant. This includes, in one embodiment, power supply, air and water manifolds, vacuum elements, and management systems.

In one embodiment, the cutting head contains a plurality of fixed plasma torches that are supported with metal spacers.

In one embodiment, the torches are configured in a horseshoe shape with the arch at the top and arcs going down to meet a flat horizontal plane at the bottom. In one embodiment, there is one larger torch in the approximate center of the horseshoe shape that extends out ~15 cm longer than the remaining torches so that this center torch (the "eye") is the first torch to come into contact with the face of the tunnel wall that is to be bored into.

In one embodiment, the cutting head is interchangeable to avoid the need for multiple tunnel boring machines depending on the desired tunnel diameter. To bore a larger tunnel, one can simply change out the cutting head for a larger diameter version, or vice versa.

In one embodiment, in the space between some (or all) of the plasma torches, a nozzle is placed to direct a stream at the wall. In one embodiment, the nozzle is a high-pressure air jet nozzle and/or a high-pressure water jet nozzle, and would be placed to apply a high-pressure stream directed at the cutting face. This introduces thermal contraction onto the hot ground surface (rock) to enhance the destruction of the bonds in the rock (break it). The stream may be a gas stream, a water stream, or a steam stream.

The cooling effect from the air and/or water jets is particularly useful in rock with high silica content (e.g. sandstone and basalt) to help break up melting (lava) portions of the rock by cooling it before it runs off the face and forms pools of lava that would be difficult to remove. Using the stream reduces the energy needed to process the rock, by breaking it up to avoid the need to vaporize the melt. The cooling streams could be applied occasionally as needed depending on the geology encountered.

In one embodiment, each of the plasma torches is approximately 100 kW or higher in DC rated capacity.

In one embodiment, the power unit for the torches and other onboard systems in the tractor is direct current (DC) and utilizes modular power supplies in increments of 200 kW to 500 kW depending on the diameter of the tunnel. In one embodiment, each power supply provides power to less than 25% of the total number of torches in the cutting head.

In one embodiment, one DC power supply is able to power 2 to 5 torches at once. In one embodiment, each power supply powers plasma torches distributed across the cutting head. Therefore, if one power supply fails, no more than 10% of the torches fail and tunneling can continue, albeit at a slower rate of penetration, until the power supply can be repaired or replaced.

In one embodiment, spoils removal is accomplished using vacuum suction at the base of the cutting head with multiple vacuum inlets, combining the vacuum streams into a metal tube, and applying high-pressure air to the tube to create a continuous stream of spoils particles being removed along the tube to the tunnel entrance.

In one embodiment, horizontally elongated narrow vacuum apertures along the base of the cutting head are used. In one embodiment, additional vacuum intakes are placed on the bottom of the cutting head.

In one embodiment, vacuum pumps and balance of vacuum equipment is located behind the tractor on a wheel and self-propelled "vacuum cart." In one embodiment, the vacuum cart consists of all metal parts in any portion that comes into contact with the spoils (for durability due to heat buildup and abrasion). In one embodiment, the vacuum filter is either removed or a minimal metal mesh filter is used for durability and efficiency.

In one embodiment, supplemental vacuum inlets are located at the front of the tractor. In one embodiment, the vacuum inlets are located on hinged, weighted arms with wheels at the bottom to keep the base of the opening of the inlet within 1-2 cm of the tunnel floor. In one embodiment, there are additional vacuum inlets at the front of the vacuum cart. In one embodiment, there are also air jets with rapid start/stop-valves to create agitation to overcome the inertia of the larger or stickier particles of spalls, gravel, small rocks, sand, and dust. These jets direct the particles towards the vacuum inlets around the vacuum cart.

In one embodiment, the vacuum inlets are combined in a manifold into a larger tube. In one embodiment, the larger tube may be up 25% of the diameter of the tunnel. This larger tube is referred to as the "primary vacuum tube" or "primary tube."

In one embodiment, behind the vacuum pumps, high pressure, cooled, compressed gas is injected into the primary tube with Venturi tube air jets blowing the spoils backward, supplemented with the use of rapid on/off valves in jets near the bottom of the primary tube to keep the spoils particles flowing backward.

In one embodiment, spoils are collected at the tunnel entrance to be processed, sorted and removed as needed. In one embodiment, an on-site "brick" manufacturing plasma furnace could melt spoils particles containing sufficiently high silica content, to convert them into formed bricks in the shapes needed to line the tunnel walls and roof.

In one embodiment, a paving tractor with a bed of high-silica-content spoils may be used to smooth the surface. In one embodiment, the paving tractor may be used after the boring tractor is finished and removed. In another embodiment, the paving tractor may follow behind the boring tractor and smooth the floor of the tunnel. In one embodiment, the paving tractor applies spoils onto the tunnel floor to smooth (pave) the surface. In one embodiment, the paving tractor melts the spoils onto the tunnel floor using downward facing plasma torches. This melts the high silica spoils, and evens out the surface of the tunnel floor. In one embodiment, the paving tractor applies a stream of silica-spoils to the plasma plumes to apply lava to the deeper pockets within the floor surface. Silica spoils are the sand, spalls and bits collected from boring the same tunnel, in one embodiment. These waste products would be sorted into silica and other materials. In one embodiment, sorting would use an industrial sifter to separate into small particles, and a centrifuge to collect the portions with a high silica content. This stream of separated silica "waste" material is sent back down the tunnel to a paving tractor robot. These particles are injected via pneumatic air jets (air mixed with the particles) into a plasma plume(s) directed to the ground (floor) of the tunnel. The silica spoils melt into a liquid material, and naturally flow to the lowest portions of the tunnel floor and cool, hardening into rock. This may be used to help smooth out the floor. In one embodiment, the paving tractor has sensors which detect uneven areas of the floor, and selectively applies spoils, which are then melted.

The following detailed description of embodiments of the invention makes reference to the accompanying drawings in which like references indicate similar elements, showing by way of illustration specific embodiments of practicing the invention. Description of these embodiments is in sufficient detail to enable those skilled in the art to practice the invention. One skilled in the art understands that other embodiments may be utilized and that logical, mechanical, electrical, functional and other changes may be made without departing from the scope of the present invention. The following detailed description is, therefore, not to be taken in a limiting sense, and the scope of the present invention is defined only by the appended claims.

FIG. 1 illustrates one embodiment of a tunnel boring system. The system includes a cutting head 110 coupled to a cutting head support 115, which together form the cutting assembly 120. In one embodiment, the cutting head 110 is coupled via a moving arm 125, so that the tractor 130 can move the cutting head. In one embodiment, the movement is only in the vertical (boom), and there is no side-to-side movement. In another embodiment, the system supports both vertical (boom) and side-to-side (swing) movement of the cutting head. In one embodiment, the side-to-side (swing) movement may be a dual swing, with joints in two locations: one at the connection point to the tractor 130 and another at the connection point where the adjustable arm connects to the cutting assembly 120. In one embodiment, the cutting head is D-shaped, with an arch at the top and straight sides. However, the cutting head may be oval, round, or another shape.

In one embodiment, the cutting assembly 120 is not powered. The propulsion is provided by the main motive tractor 130, via a power supply. In one embodiment, the main motive tractor 130 also includes sensor(s) and camera (s). The main motive tractor 130 includes the motive power, as well as sensors, cameras, and other devices. In one embodiment, at least some of the sensors and/or cameras extend from the tractor 130 to the cutting head, to provide image and sensor data from as near to the cutting head as possible. Vacuum cart 140 provides the vacuum for the collection of removed rock. In one embodiment, the vacuum cart 140 is self-propelling. This places less burden on the main motive tractor 130. In another embodiment, the vacuum cart 140 is not self-propelled, and is pulled by the main motive tractor 130 and/or pushed by the paving tractor 150.

The paving tractor 150 may be used to smooth the tunnel floor. The paving tractor 150 receives separated waste product, returned from the tunnel entrance. In one embodiment, silica spoils are used. Silica spoils are some of the sand, spalls and bits collected from boring the same tunnel, and removed via spoils removal tube 160 to spoils collection 175 outside the tunnel entrance. In one embodiment, the silica spoils are repurposed "waste" spoils that are sorted at the surface, by spoils separator 177, into silica and other spoils. In one embodiment, an industrial sifter is part of spoils separator 177, and is used to separate the spoils into large chunks and small particles. In one embodiment, the small particles are then run through a centrifuge, which is part of spoils separator 177, to collect the portions with a high silica content, which is the paving silica 178. This stream of separated silica spoils, or paving silica 178, is sent back down the tunnel to the paving tractor 150. The paving tractor then deposits them into the uneven portions of the tunnel floor.

In one embodiment, the paving tractor 150 may also line the tunnel walls and arched roof with material to reinforce the tunnel. The lining may be with shotcrete, concrete or other material(s). In one embodiment, the paving tractor 150 may include nozzles used to spray the liquid tunnel lining product(s) onto the walls and/or arched roof of the tunnel. The paving tractor 150 may include rotating injector arms, to deposit the tunnel lining products, in another embodiment.

The system receives power, water, air, and in some embodiments separated silica spoils and/or tunnel lining material(s), through inbound tube 155 from the tunnel entrance 170. In one embodiment, there is an air compressor 185, a water source 190, and a chiller 195 to provide cold air and water for the cutting head 110. Power source may be provided by mobile substation 180. In another embodiment, power may be provided by solar power, or other sources.

In one embodiment, the inbound tube 155 provides power for the motive tractor 130, as well as the torches on cutting head 110. The water and/or compressed air is used by the cutting head 110 as will be discussed below. In one embodiment, the umbilical 135 and spoils removal 160 tubes go along the entire system, from the cutting head all the way to the last tractor, here paving tractor 150.

The spoils removal tube 160 removes the spoils generated by the tunnel boring, to spoils collection 175. There are vacuum inlets along the system. In one embodiment, the first vacuum inlet is on the cutting head 110, and then on the main motive tractor 130, and on vacuum cart 140. In one embodiment, the spoils removal tube 160 is powered by vacuum cart 140, which pushes the spoils through the spoils removal tube 160. In one embodiment, the spoils are accelerated in the tube 160 through Venturi tubes 165. The vacuum sucks up all of the bits and then behind the vacuum cart 140 is the spoils removal tube 160 that has Venturi tube air jets 165 in the first few meters to accelerate the spoils removal airflow and additional Venturi jets along the way to maintain the velocity of the spoils removal. In one embodiment, the first section of the spoils removal tube 160 is rigid metal. In one embodiment, the metal is stainless steel due to its hardness and lower cost than other alloys. Subsequent sections of the spoils removal tube 160 would be flexible but not corrugated so that it has a smooth interior to optimize air flow. In one embodiment, additional vibration plates 168 are positioned under the spoils removal tube 160, or within the spoils removal tube 160. The vibration plates 168 are designed to shake the spoils which settle on the bottom of the tube and accelerate them back into the air flow. In one embodiment, there may be additional power elements along the path of the inbound and outbound tubes, if the tunnel is above a certain length. This enables the extension of the tunnel boring system into deeper tunnels by providing additional motive power, for the tubes as well as the materials being brought to the tunnel boring machine and being removed from the tunnel. In another embodiment, these power elements may power booster pumps to boost air and/or water pressure, power factor correction and power conditioning devices such as voltage and/or frequency regulators, additional sensors, and other equipment.

This self-contained boring machine provides an efficient system which can bore through various kinds of rock, and provide fast and efficient tunnel boring.

Figure 2:
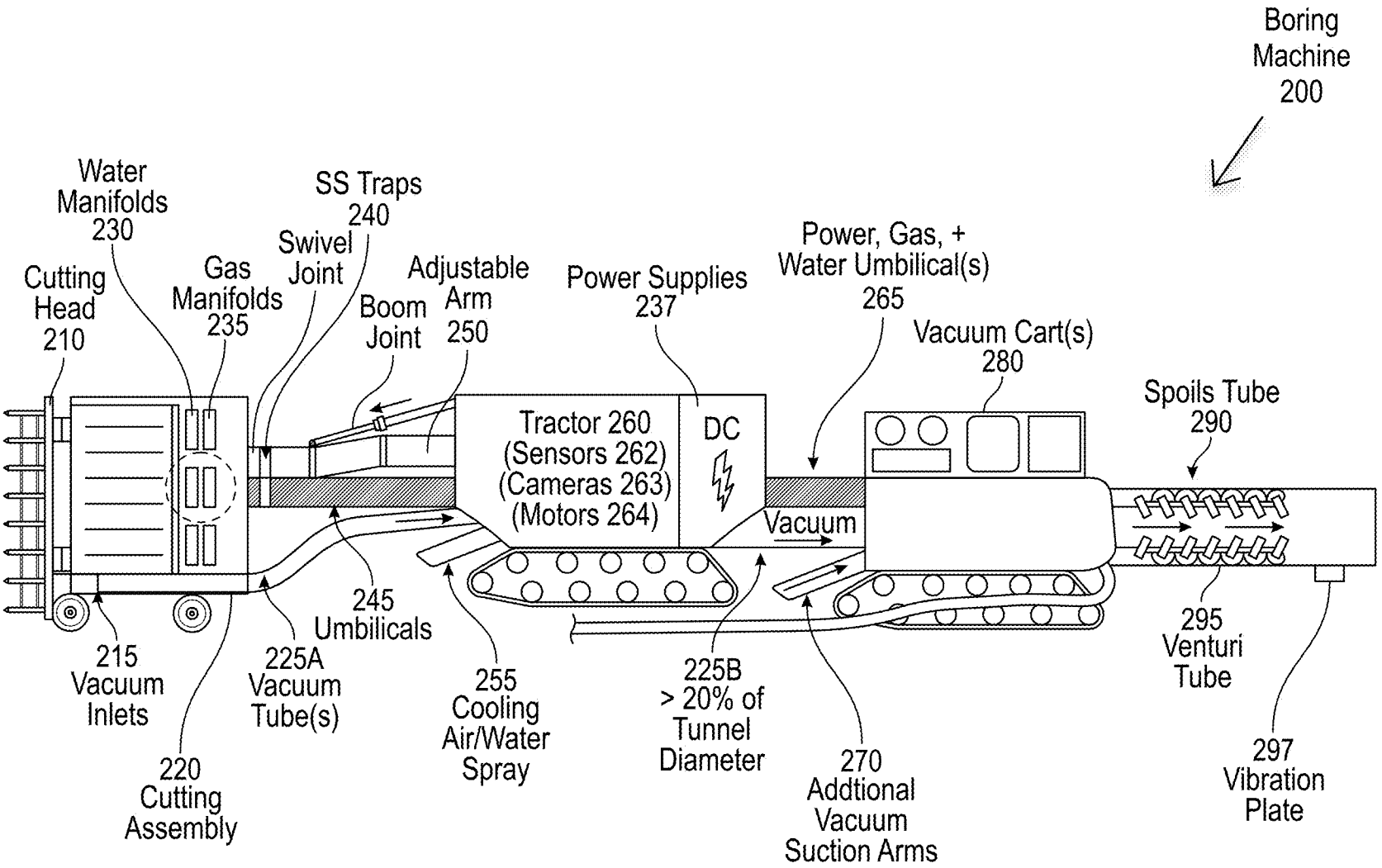
FIG. 2 illustrates a side view of one embodiment of a portion of the tunnel boring system.

FIG. 2 is a side view of one embodiment of the tunnel boring system. The cutting head 210 is attached to the cutting assembly 220. The cutting head 210 includes torches and nozzles for a stream of air and/or water, to assist with the boring. The power, and air/water are fed to cutting assembly 220 via umbilicals 245. In one embodiment, a non-transferred Arc Plasma Torch (APT) from PYPROGENSIS™ is used. In one embodiment, the non-transferred plasma arc torch PT250 by PHOENIX SOLUTIONS™ is used. Other torches may be utilized.

In one embodiment, cutting assembly 220 includes vacuum inlets 215, on the bottom, to vacuum up the debris from the boring. This debris is passed through vacuum tubes 225A, 225B, through spoils tube 290, out of the tunnel. The cutting assembly 220 also includes water manifolds 230 and gas manifolds 235 for the air and water jets. The cutting assembly 220 may also include an adjustable arm 250 to move the cutting head 210. In one embodiment, the joints are protected from heat and abrasive particles by traps 240, which may be stainless steel.

In one embodiment, the adjustable arm 250 enables the movement of the cutting head to change the direction of the tunnel being bored. In one embodiment, the adjustable arm 250 may be the lifting arms of a front end loader tractor. In one embodiment, the cutting assembly 220 may also include some portion of the power supplies 237 to power the torches on the cutting head 210. In one embodiment, the tractor 260 includes a plurality of power supplies 237, and each power supply powers a subset of the torches on the cutting head 210. In one embodiment, the subset of torches powered by a power unit are not adjacent to each other. In one embodiment, the power supplies 237 power a distributed set of torches, such that the system can continue to be used if one of the power supplies stops functioning. In one embodiment, any one power supply 237 powers no more than $1/4^{th}$ of the torches. Power, gas, water, and other resources are supplied to the tractor 260 through umbilicals 265, from outside the tunnel.

In one embodiment, the cutting assembly 220 includes metallic wheels, which are not powered. Rather, power is provided by the second tractor 260. The metallic wheels, however, are designed to withstand the hot lava and rocks from the stone bored through by the torches.

In one embodiment, the cutting assembly 220 also includes one or more sensors. Alternatively, the sensors may be on the second tractor 260.

The second tractor 260 includes the electric motor(s) 264 to move the cutting assembly and power the adjustable arm and other subsystems. In one embodiment, the torches are plasma torches which have a power between 200 kW and 3,000 kW. In one embodiment, each plasma torch has a 500 kW rated capacity.

The second tractor 260 also includes sensors 262 and cameras 263, in one embodiment. In one embodiment, the sensors may include cameras, sonars, lasers, lidars, level sensors, temperature sensors, flow rate and pressure sensors for air and water, gyroscopic, magnetic, GPS and/or other locational sensors, or other sensors. The sensors 262 and cameras 263 provide data to the operator. The operator, in one embodiment, provides remote control guidance to the boring machine 200. In one embodiment, the boring machine 200 is generally self-guided, with supervision by an operator.

In one embodiment, the sensors 262 provide data about the air in the tunnel, including whether there is flammable gas. Gas can be dangerous to a plasma boring machine 200 because it may cause explosions. In one embodiment, a sensor 262 may be coupled to an auto-shut-off mechanism to automatically shut down the torches if certain gasses are detected in dangerous concentrations, and/or increase the water flow to the water jets to mitigate the explosive potential of the gas or gasses.

In one embodiment, the cameras 263 and sensors 262 provide data about the type of rock that is being bored through. Such sensors may include molecular scanners and gas detectors to ascertain the minerology of the rocks at the cutting surface. Different compositions of rock may be drilled with different power settings, air flow settings, and water/steam settings. For example, a high silica rock may be best removed with a lower power setting, and with more cold air than basalt. In one embodiment, in addition to the sensors 262 on the tractor 260, additional analysis may take place on the surface based on the removed rocks and debris.

In one embodiment, the second tractor 260 may also include cooling air/water spray 255, directed at the floor of the tunnel. This ensures that the second tractor 260 does not pass over rock that is hot enough to cause damage. In one embodiment, the cooling air/water spray is designed to provide just enough water for cooling, which evaporates, so that the debris does not become a muddy mess that is hard to remove, but rather can be vacuumed up by vacuum cart 280.

In one embodiment, a vacuum cart 280 is coupled to the second tractor 260. The vacuum cart 280 vacuums up the debris from the floor, and also receives the debris vacuumed by vacuum inlets 215 in the cutting assembly 220. In one embodiment, the vacuum inlets are made of metal, and include a chilling sleeve, as shown, to cool them using chilled air or water. The vacuum cart 280 also controls the return of the waste to the surface. In one embodiment, a spoils tube 290 extends from the boring machine 200 to the surface, to return the waste material.

In one embodiment, a series of Venturi tubes 295 are inserted along the spoils tube 290. The Venturi tubes 295 face toward the tunnel entrance, to accelerate airflow within the spoils tube 290 to remove the waste particles over longer distances. In one embodiment, Venturi tubes 295 are placed periodically along the spoils removal tube 290. In one embodiment, the Venturi tubes 295 are placed approximately every 10-30 meters, and are connected to air supply lines to continue to maintain the velocity of the airflow and particle flow moving backwards towards the tunnel entrance. In one embodiment, the Venturi tubes 295 are placed at varying angles to create sufficient agitation of airflow, including vortexes, eddies, and wind shear to help lift any "stuck" particles in the tube 290. In one embodiment, a vibration plate 297 may also be inserted underneath the tube 290, or in the bottom of the tube, to shake any particles that detach from the airflow and settle on the bottom of the tube, to be picked up by the agitated airflow. In one embodiment, the Venturi tubes 295 are placed every 20 meters, and vibration plates 297 are also every 20 meters, such that there is a vibration plate or a Venturi tube every 10 meters.

Figure 3:
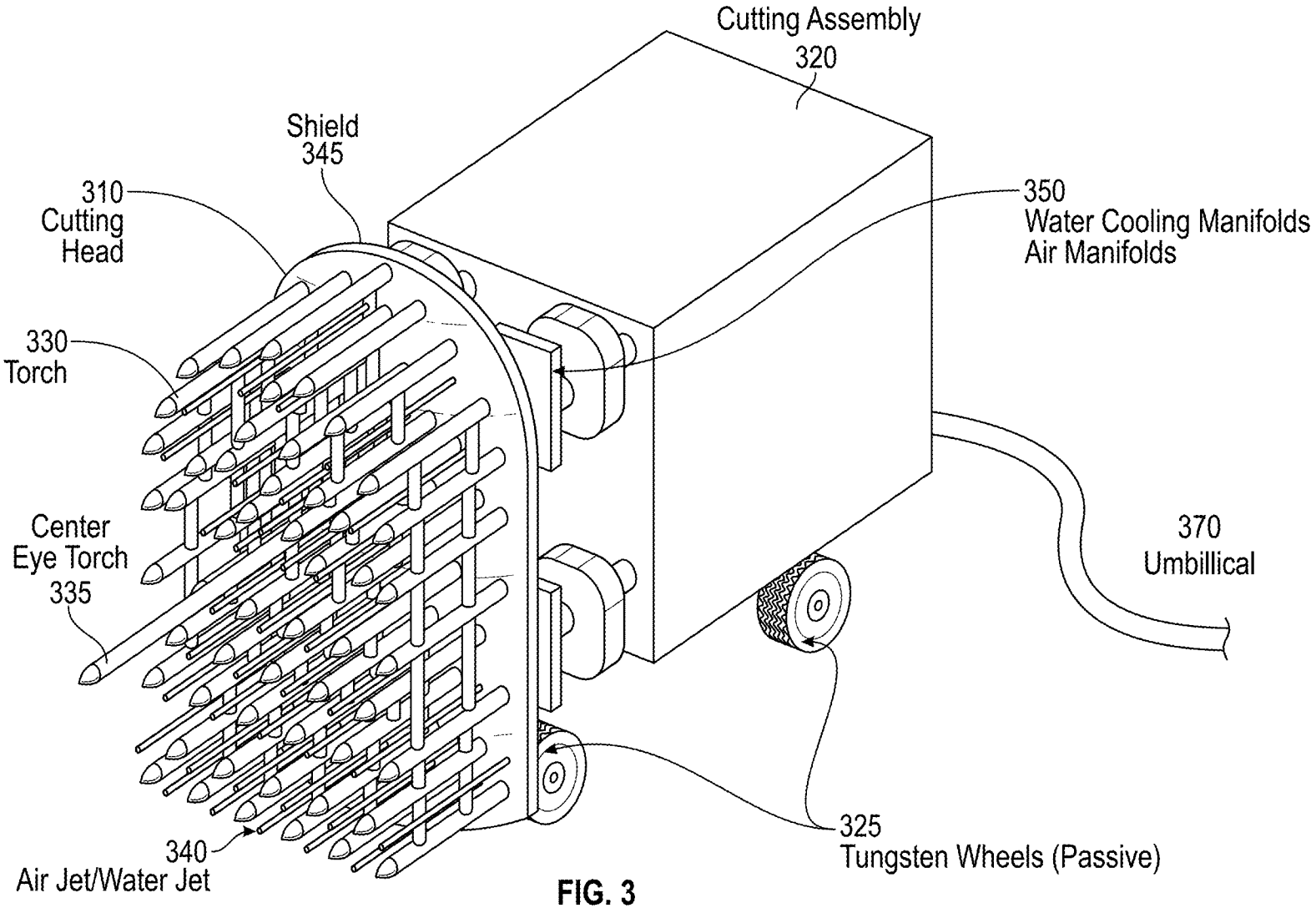
FIG. 3 illustrates a perspective view of one embodiment of the cutting assembly.

FIG. 3 is a perspective view of one embodiment the cutting assembly in the tunnel boring system. The system includes a cutting assembly, with an attached cutting head 310. In one embodiment, the cutting head 310 is replaceable. This enables adjustment of the cutting head for the particular rock composition.

The cutting head includes a plurality of torches 330. In one embodiment, the torches 330 are arranged in a pattern. In one embodiment, the center torch 335 extends longer than the other torches 330. In one embodiment, the center torch 335 extends by 15 to 45 cm beyond the other torches 330. In one embodiment, the center torch 335 is extended proportionally to the other torches. The purpose of having the longer center torch 335 is to enable heat and spoils material to more easily escape from the cutting surface. This may be useful for basalt and sandstone type rocks. The extended torch 335 in one embodiment is in the center of the cutting head 310, at or near the top of the cutting head 310.

In addition to the plasma torches 330, there are air or water jets 340 on the cutting head 310 to direct a stream at the rock being cut by the borer. The air or water jets 340 output air and/or water. The air and/or water is useful to help split the rock. However, the system does not use drilling mud and water. The stream may be a stream of cold air via an air jet 340, or a stream of water via water jet 340, or a combination of air and water. In one embodiment, a very small amount of water is used, which turns to steam or evaporates due to the high temperature from the torches 330, as it impacts the boring surface. This keeps the spoils from being muddied, and made heavier, by the water. In one embodiment, the temperature and water volume is adjusted based on the type of rock. In one embodiment, the air and/or water are chilled to a very low temperature, to create a greater temperature delta in the rock to optimize thermal cracking, to increase the rate of penetration. In one embodiment, the temperature of the plasma plume ranges from greater than 2,000° C. at the edges and up to 27,000° C. in the center of the plume and the water and/or air jets are between 3° C. and 15° C.

The configuration of the cutting head, the stand-off distance, and type of stream (water or air) may be adjusted based on the type of rock being bored through. Table 1 illustrates exemplary settings.

TABLE 1

Table for rock type & variables to adjust

| Rock Type | Stand-off distance (cm) | Water (Volume & Temp) | Cold Air Jets (Volume & Temp) |
|---|---|---|---|
| Sandstone | ~5-10 | High, very cold | High, very cold |
| Basalt | ~20-30 | None to Moderate, cold | Moderate to High, cold |
| Misc. rock with high Silica content | ~20-30 | None to Moderate, cold | Moderate to High, cold |
| Misc. rock with low Silica content | ~5-20 | None | Intermittent, as needed |

The cutting head 310 in one embodiment has a shield 345, which insulates the cutting assembly 320 and portions of the system behind the cutting head from the high heat produced by the torches 330. In another embodiment, this shield is concave in shape and made of a material designed to reflect thermal energy and sound waves back towards the cutting surface to assist the boring process by increasing efficiency and the rate of penetration.

In one embodiment, the cutting head 310 is coupled to the cutting assembly 320 via moveable arms. The tractor transmits the power for the torches 330, as well as the air or water for the jets 340. In one embodiment, the cutting head 310 and cutting assembly 320 have wheels 325. In one embodiment, the wheels 325 are made of tungsten or another metal that can withstand the heat produced by the torches 330. In one embodiment, an umbilical 370 connects the cutting assembly 320 to external elements.

Figure 4:
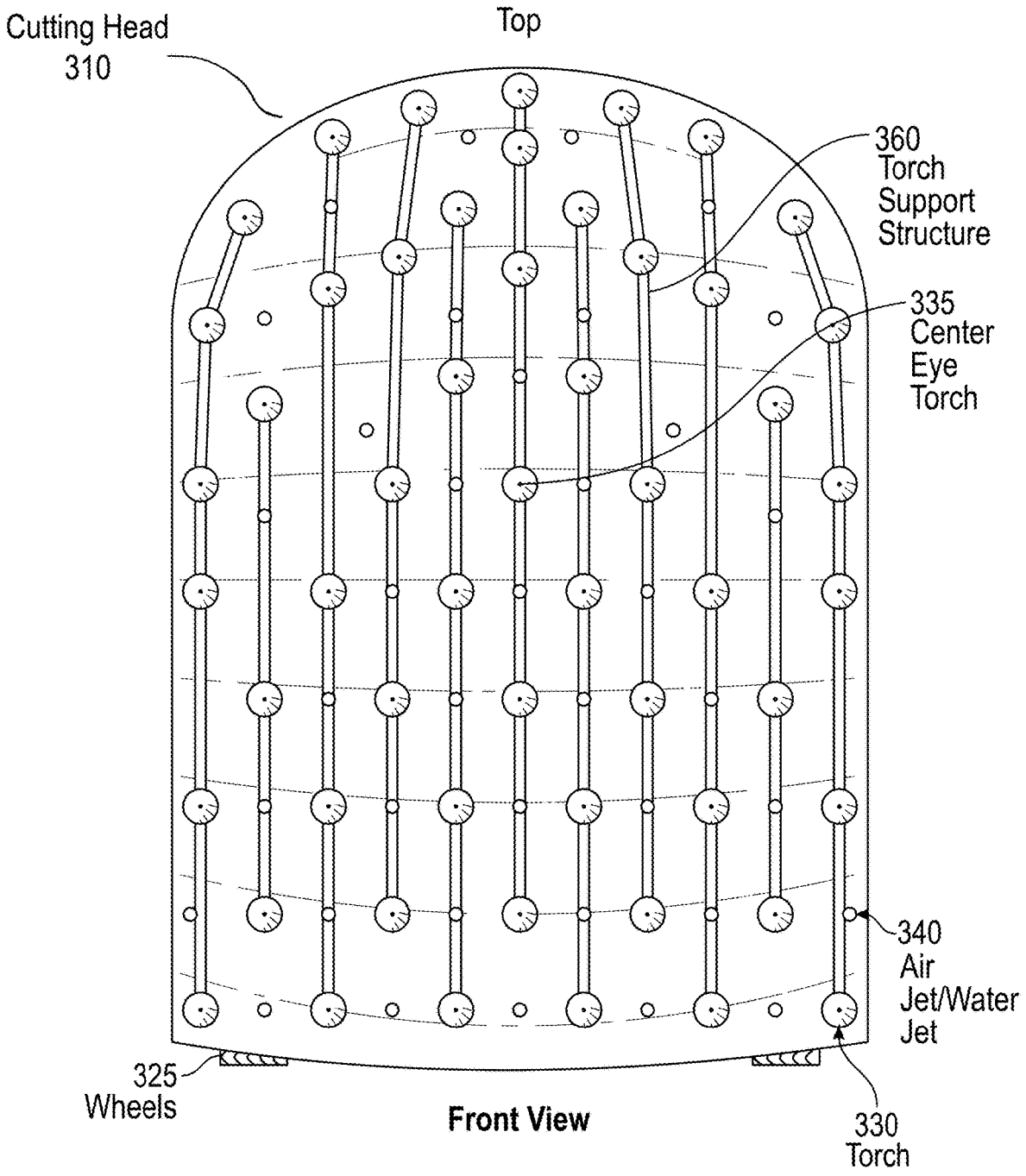
FIG. 4 is a front view of one embodiment of the cutting head.

FIG. 4 is a front view of one embodiment of the cutting head of FIG. 3. The cutting head 310, in one embodiment, is shaped to create a D-shaped tunnel, with an arch roof and vertical walls. By matching the shape of the cutting head 310 to the intended shape of the tunnel, the post-boring processes can be reduced, in one embodiment.

The front view shows the torch support structure which supports the torches 330 extending from the cutting head 310. It also illustrates an exemplary position for the center eye torch 335. The support structure 360 provides, in one embodiment, support between the torches 330 on the cutting head 310.

The cutting head 300 also includes air jets and water jets 340 in one embodiment. In one embodiment, as shown, the air/water jets 340 are positioned along the edge of the cutting head 300, primarily at the top and bottom. The air/water is used to introduce changes in temperature to cause fractures in the rock being tunneled through. In one embodiment, the turning on and off of the air/water jets 340 is selective, and based on the composition of the rocks being tunneled through.

Figure 5:
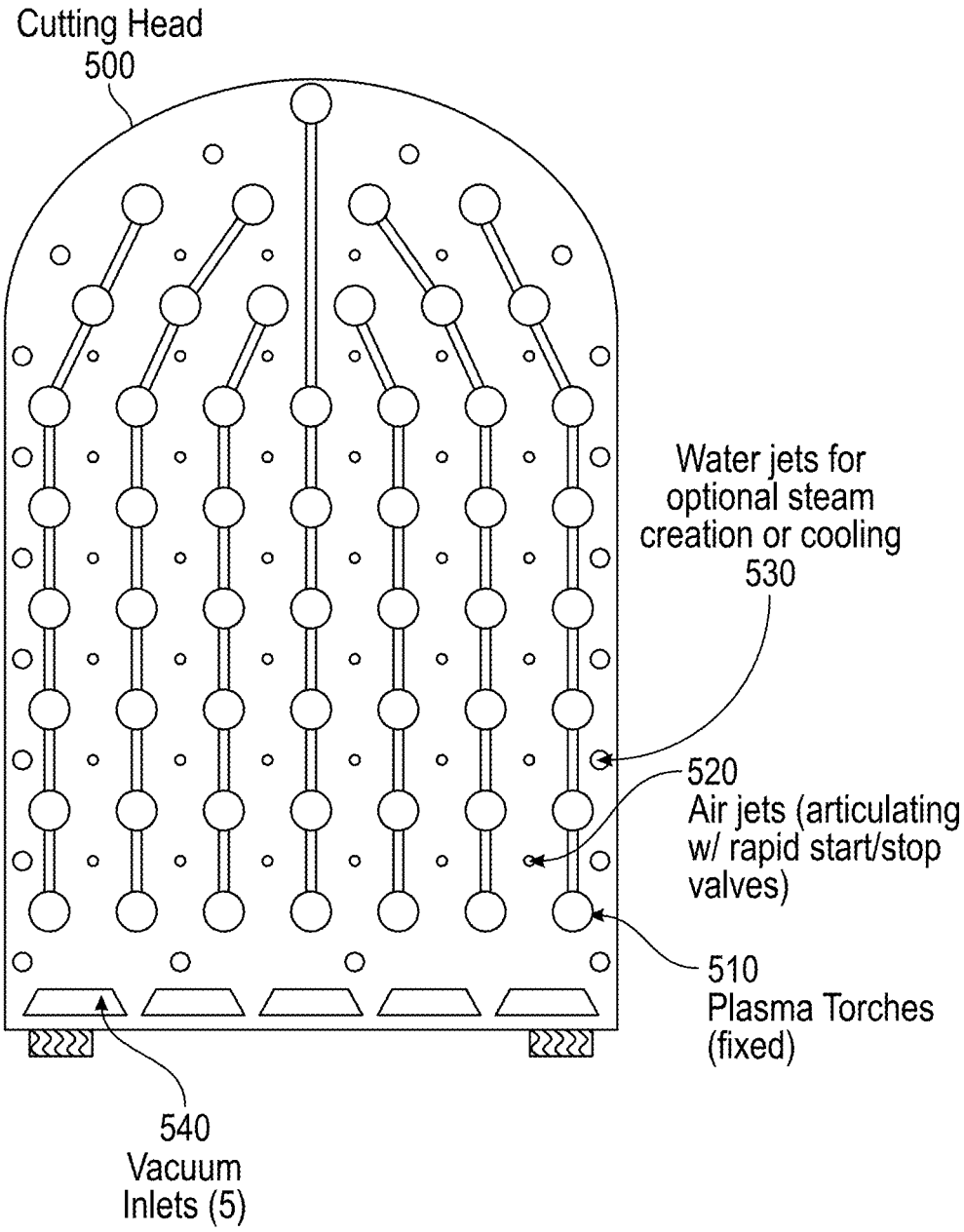
FIG. 5 is a front view of another embodiment of the cutting head.

FIG. 5 is a front view of another embodiment of the cutting head 500. In this configuration, there are more torches 510. There are, in this configuration, seven torches across the bottom of the cutting head 500, and at most eight torches vertically. However, this is merely exemplary, and it should be understood that the actual arrangement of the individual torches may vary without departing from the present invention.

In one embodiment, air jets 520 are positioned throughout the cutting head 500, whereas water jets 530 are positioned around the outside area of the cutting head 500. In one embodiment, the air jets are articulating jets, meaning that the air can be directed. In one embodiment, the air jets 520 include rapid start/stop valves. In one embodiment, the valves are electronically controlled solenoids between the nozzle and the supply line valve(s). The rapid pulsing of cold air may be used to fracture certain types of rocks. In one embodiment, as will be explained in more detail below, the system includes sensors which detect the air type and adjust the functioning of the cutting head 500 based on the data. In one embodiment, an operator controlling the boring system may adjust the air jets, and water jets. In one embodiment, the steam/water from water jets 530 and/or the cold air from air jets 520 are used to break up the lava for spoils removal.

In addition in one embodiment there are vacuum inlets 540 at the bottom of the cutting head 500. The vacuum inlets 540 are used to vacuum up the spoils to remove them. In one embodiment there are between one and ten vacuum inlets. In one embodiment, the vacuum inlets are approximately 1 cm to 20 cm above the floor of the tunnel. In another embodiment, the vacuum inlets 540 may be on flexible arms and have wheels positioned to allow the inlets 540 to remain in consistently close contact with the floor and move along with bumps and imperfections in the floor surface. In one embodiment, the vacuum inlets are metal, of a material designed to withstand the hot rocks. In one embodiment, the vacuum inlets are cooled using air or water, to cool the rocks sufficiently to travel along the remaining portion of the spoils removal tube. In one embodiment, the vacuum inlets and portions of the vacuum tubes are lined with a chilling sleeve that contains circulating chilled water, with a return water line located on the exterior of the tube(s). In one embodiment, the chilling sleeve is located on all vacuum collection subsystems. In one embodiment, the chilling sleeve extends for a distance. In one embodiment, the distance may be up to 10 meters behind the paving tractor.

Figure 6:
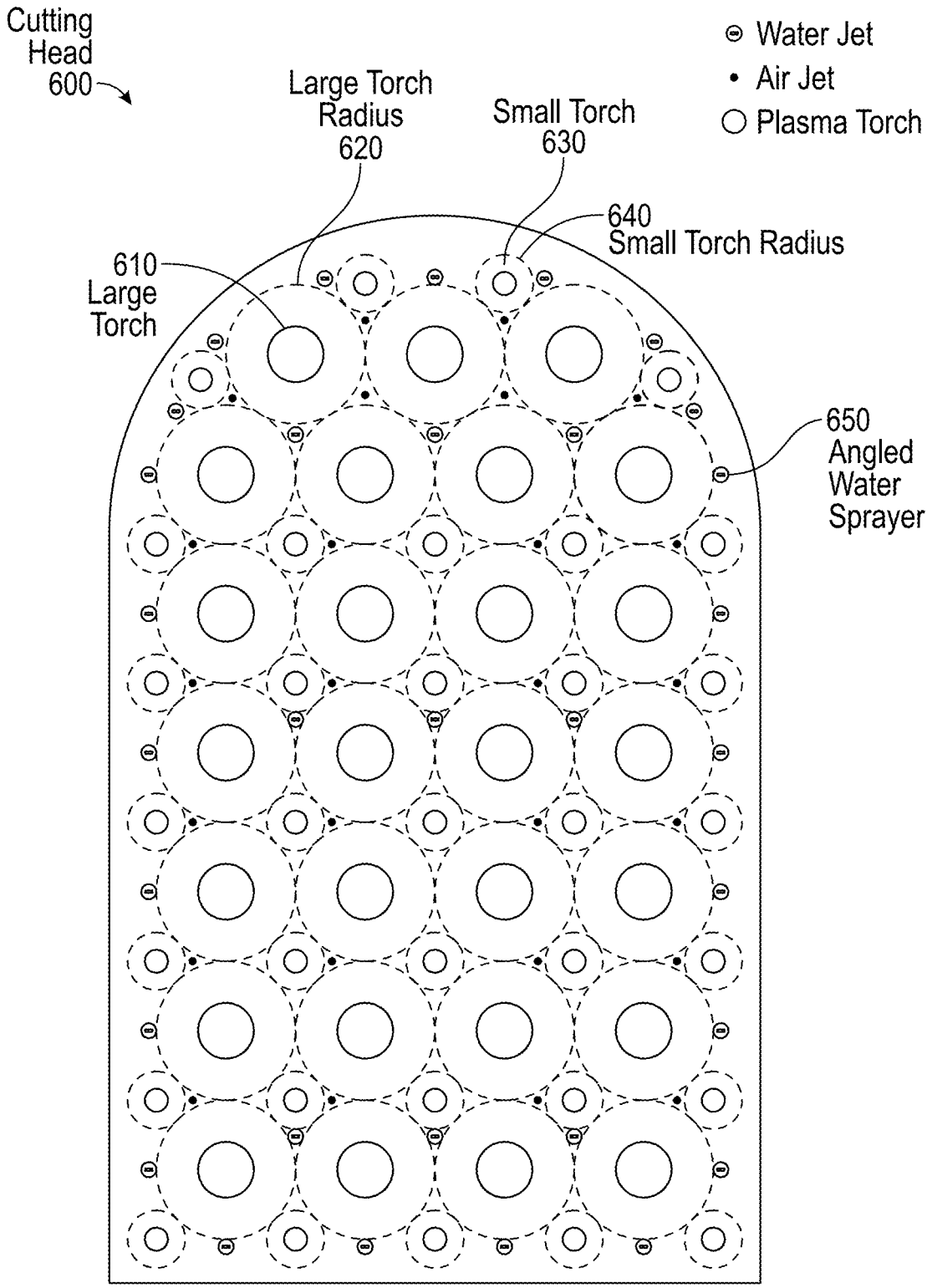
FIG. 6 is a front view of another embodiment of a cutting head, with two torch sizes.

FIG. 6 illustrates of one embodiment of a cutting head, showing the cutting diameters of the torches. The cutting head 600 includes two different size plasma torches, large torches 610 and small torches 630. In this illustration, in addition to the torch diameter, the torch radius is illustrated with dashed lines. As can be seen, the combination of large torches 610 and small torches 630 provides full coverage of the area. In one embodiment, each torch plume extends to 2.5 times the diameter of the torch head size 610, 630. The actual tunnel boring potential of each torch thus extends beyond the illustrated radiuses 620, 640, such that within the cutting head 600 the torch plumes intersect, and the torch cutting extends beyond the cutting head. In one embodiment, the small torches 630 may be unnecessary due to the synergies of multiple torch plasma plumes creating higher temperatures at the edges at the confluence of the plumes.

The water jets, as shown, provide an angled water sprayer 650, in one embodiment. The angling ensures that the water is sprayed to the appropriate locations to assist in the splitting of the rock, without muddying the spoils. In one embodiment, the direction that the angled water sprayer 650 sprays may be altered by the operator.

Figure 7:
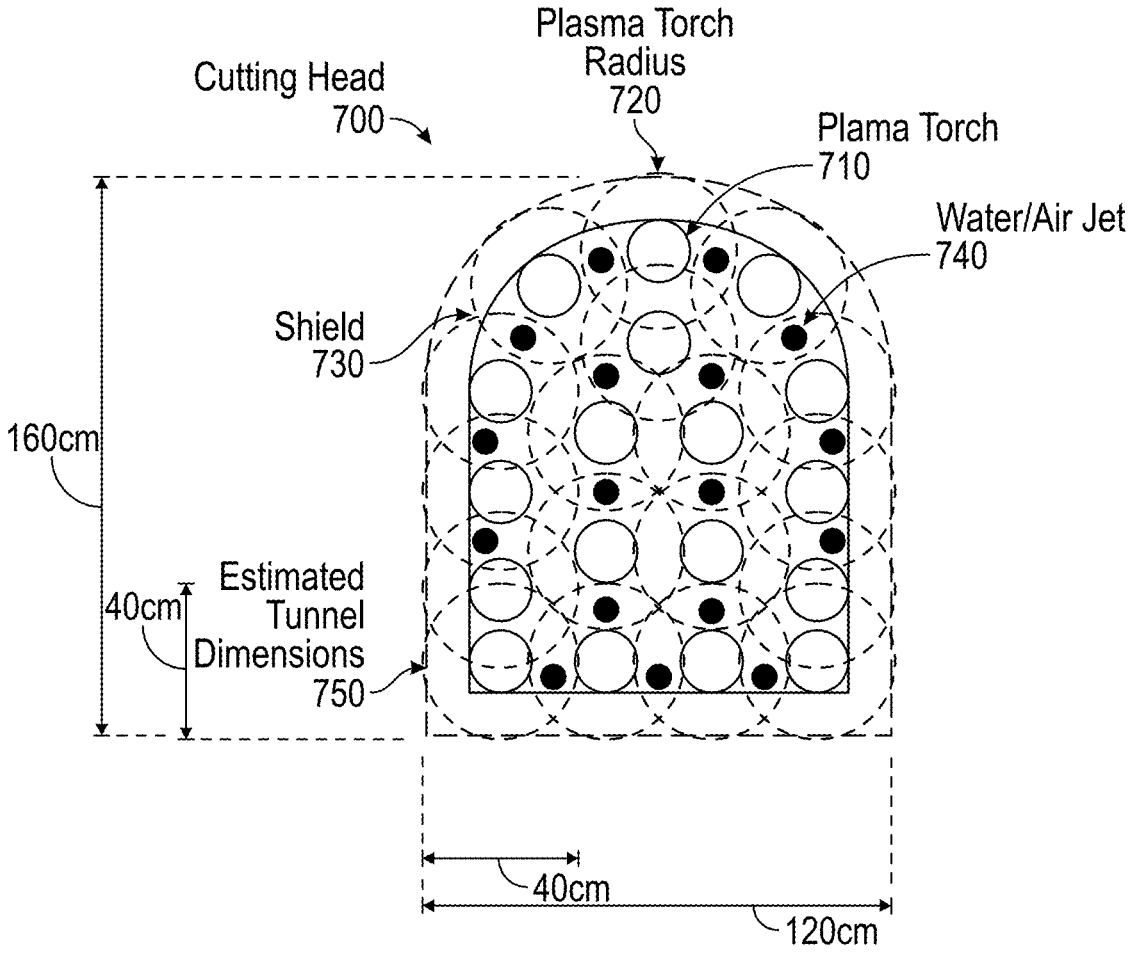
FIG. 7 is a front view of another embodiment of the cutting head showing excess tunnel boring potential.

FIG. 7 illustrates another embodiment of a cutting head, showing the excess tunnel boring potential of the torch plumes, beyond the diameter of the shield. The cutting head 700 is a smaller configuration. In this example, there are no gaps between the effective radiuses 720 of the plumes produced by the plasma torches 710, and the effective radiuses overlap. The radiuses 720 of the torches 710 extend beyond the edge of the shield 730, enabling the shield 730 to pass through the path cut by the torches 710.

In one embodiment, the use of multiple torches creates a synergy. This may double or triple the thermal and kinetic energy applied to the surface areas where there is a confluence of two or three plasma plumes. This increases the boring capacity by utilizing "waste" heat at the edges of a plasma plume that does not have sufficient energy to bore the rock on its own, or not as quickly as the areas of the plume closer to the core of the plume, but when combined with the waste heat from another overlapping torch plume, rock in that "islanded" area breaks apart, and may do so faster than would be expected with only one plasma plume. This eliminates the need for the small torches in the gaps.

Water jets 740 are dispersed between the torches. In one embodiment, air jets may also be present. This figure also shows some exemplary dimensions of a cutting head 700, which has a "torch" height of 160 cm, and width of 120 cms, with the torches having a torch radius 615 of 40 cm by 40 cm. Thus, the estimated tunnel dimensions 750 of the tunnel bored by the cutting head would be 160 cm, or 5'3" by 120 cm or approximately 3'11". These dimensions are of course merely exemplary.

Figure 8B:
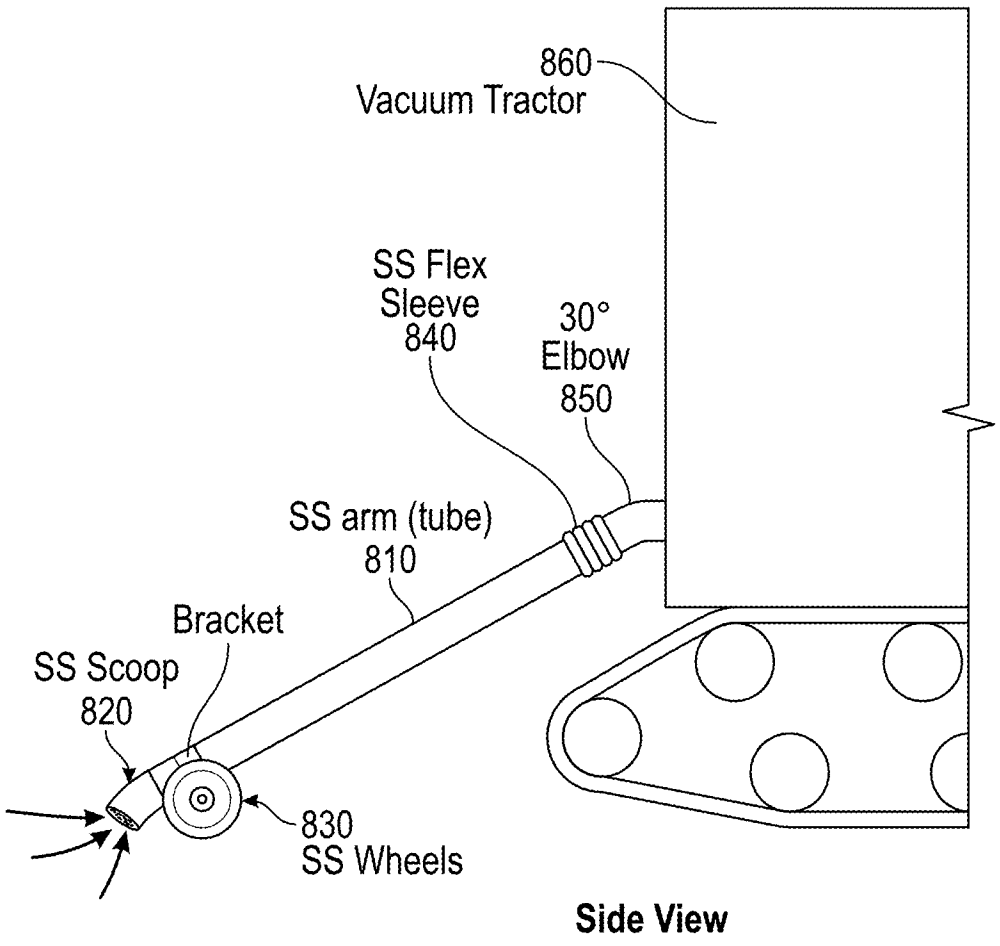
FIGS. 8A and 8B illustrate one embodiment of the vacuum tractor with hinged vacuum inlets.
Figure 8A:
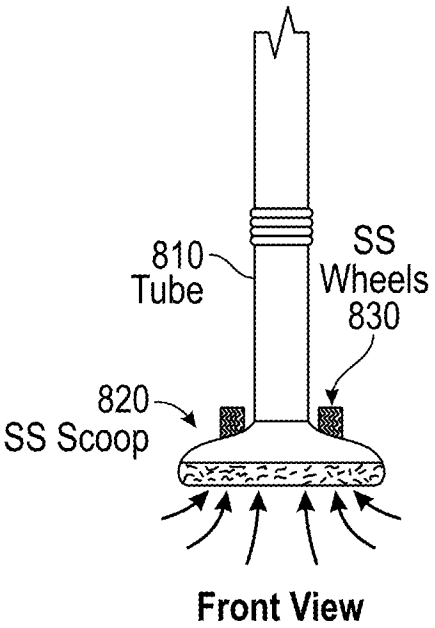

FIGS. 8A and 8B illustrate one embodiment of hinged vacuum inlets. In one embodiment, the front of the vacuum tractor includes vacuum arms. FIG. 8A illustrates a front view and FIG. 8B illustrates a side view of embodiments of the vacuum arms of the vacuum tractor 860. The vacuum tractor 860 has an extending tube 810, which bends down toward the floor. The extending tube 810, in one embodiment, has a scoop 820 to capture the pieces remaining on the floor. In one embodiment, wheels 830 provide support for the scoop 820 to keep it close to the floor. In one embodiment, the tube 810 includes a flexible sleeve 840, and an elbow 850. In one embodiment, a single vacuum tractor 860 may include three hinged vacuum arms, across the front. In one embodiment, the vacuum scoops 820 cover most of the floor of the tunnel. In one embodiment the parts are made of a metal to withstand the heat of the heated spoils. In one embodiment, the metal is stainless steel. As noted above, in one embodiment, the vacuum arms may have chilling sleeves, to cool the spoils.

FIG. 8B illustrates a front view of a hinged vacuum inlet. The scoop in one embodiment is curved forward, such that it pulls spoils in from in front of it. In one embodiment, this configuration for a vacuum inlet may also be used on the cutting head, the motive tractor, with other parts of the boring system.

Figure 9A:
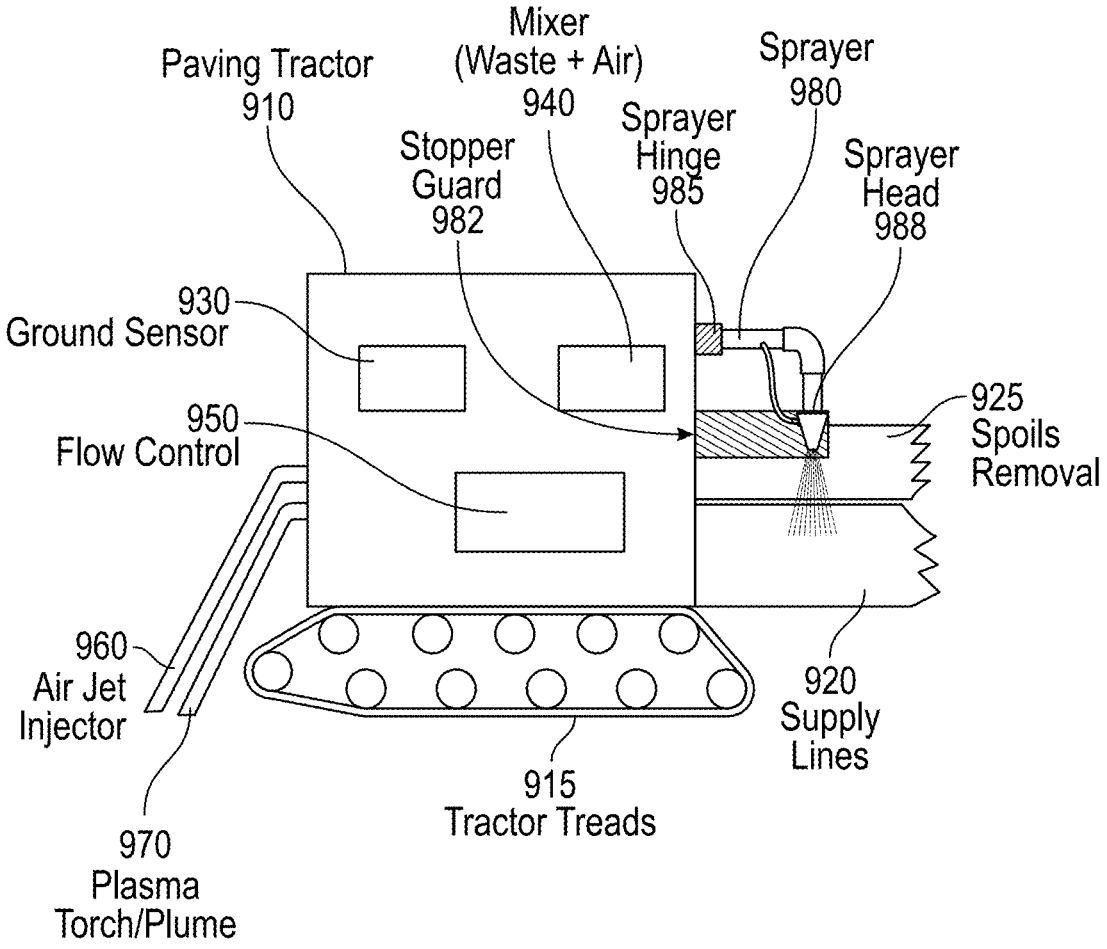
FIGS. 9A and 9B illustrate one embodiment of the paving tractor.

FIG. 9A illustrates a side view of one embodiment of the paving tractor. In one embodiment, the paving tractor 910 receives inbound high silica waste through supply lines 920. In one embodiment, the inbound material is very small particles of silica. The tractor 910 also receives inbound air/gas, as well as power, in one embodiment, through supply lines 920. Additionally, in one embodiment the tractor 910 receives tunnel lining product through supply lines 920. In one embodiment, ground sensor 930 monitors the floor with one or more sensors. In one embodiment, the ground sensor 930 monitors the tunnel floor in front of the paving tractor 910, before the tractor treads 915. The ground sensors 930 may include one or more of: cameras, sonars, lasers, lidars, level sensors, and temperature sensors. The mixer 940 mixes the inbound air and silica waste to create a particle mix. The particle mix, in one embodiment, is injected via pneumatic air jets 960 into a plasma plume(s) from plasma torch 970, that is directed to the ground (floor) of the tunnel. Flow control 950 controls the particle mix and the plasma torch 970. In another embodiment, the particle mix may be injected directly into the air supply for the plasma torch 970. The silica melts into a liquid lava type material, and naturally flows (using gravity) to the lowest portions of the tunnel floor and cools. This hardens into rock, which helps smooth out the floor.

In one embodiment, paving tractor 910 also includes a material applicator or sprayer 980 to line the tunnel walls and arched roof with tunnel lining products. Tunnel lining products may include shotcrete, concrete or other materials. In on embodiment, the tunnel lining product is fiber reinforced shotcrete (FRS). In one embodiment, applicator 980 comprises one or more rotating injector arms, to dispense the material onto the tunnel walls. In another embodiment, the material applicator 980 may be nozzles used to spray liquid tunnel lining products onto the walls and/or arched roof of the tunnel. In one embodiment, sprayer 980 is hinged, so it can rotate. The sprayer 980 in one embodiment is one arm, rotating from a center pivot 985 mounted near the top center of the back of the paving tractor 910, that rotates up to 360 degrees but is designed to rotate about 270 degrees to cover the full sides and roof of the tunnel. The sprayer 980 is stopped by stoppers at the umbilical spoils removal and supply tubes below it, then reverses rotational direction to go back the other way until it again stops at the bottom so that it's not spraying the floor or the supply lines.

Figure 9B:
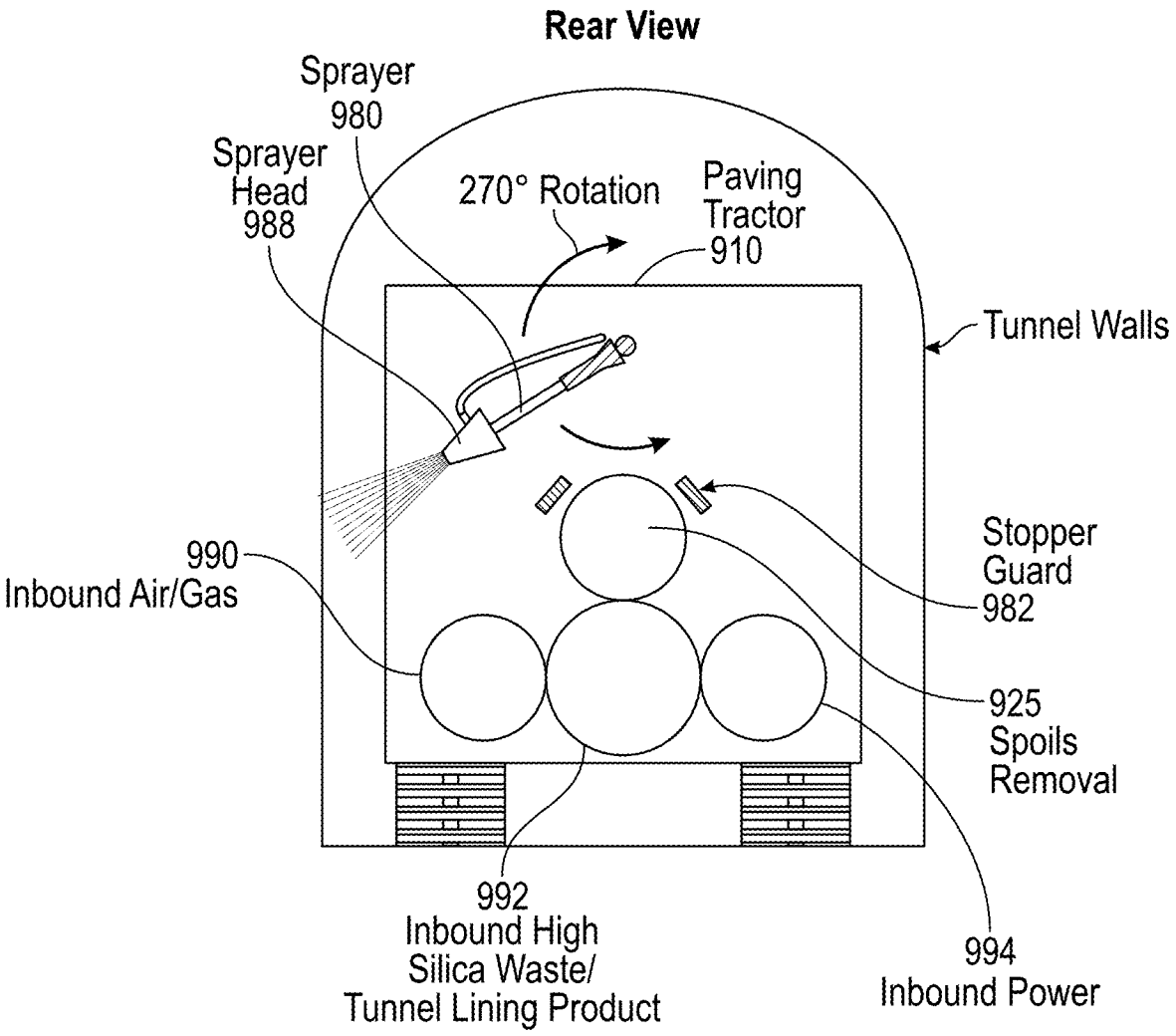

FIG. 9B illustrates a back view of the paving tractor of FIG. 9A. The sprayer 980 rotates around a central hinge 985, to spray material onto the tunnel walls. In one embodiment, the sprayer 980 rotates approximately 270 degrees between stopper guards 982. The stopper guards may be provided on spoils removal tube 925. The arrangement of the individual supply lines 990, 992, 994 and spoils removal lines 925 is arbitrary, in one embodiment, and one or more of them may be combined within a single supply tube which has interior separations, separating the various materials.

Figure 10:
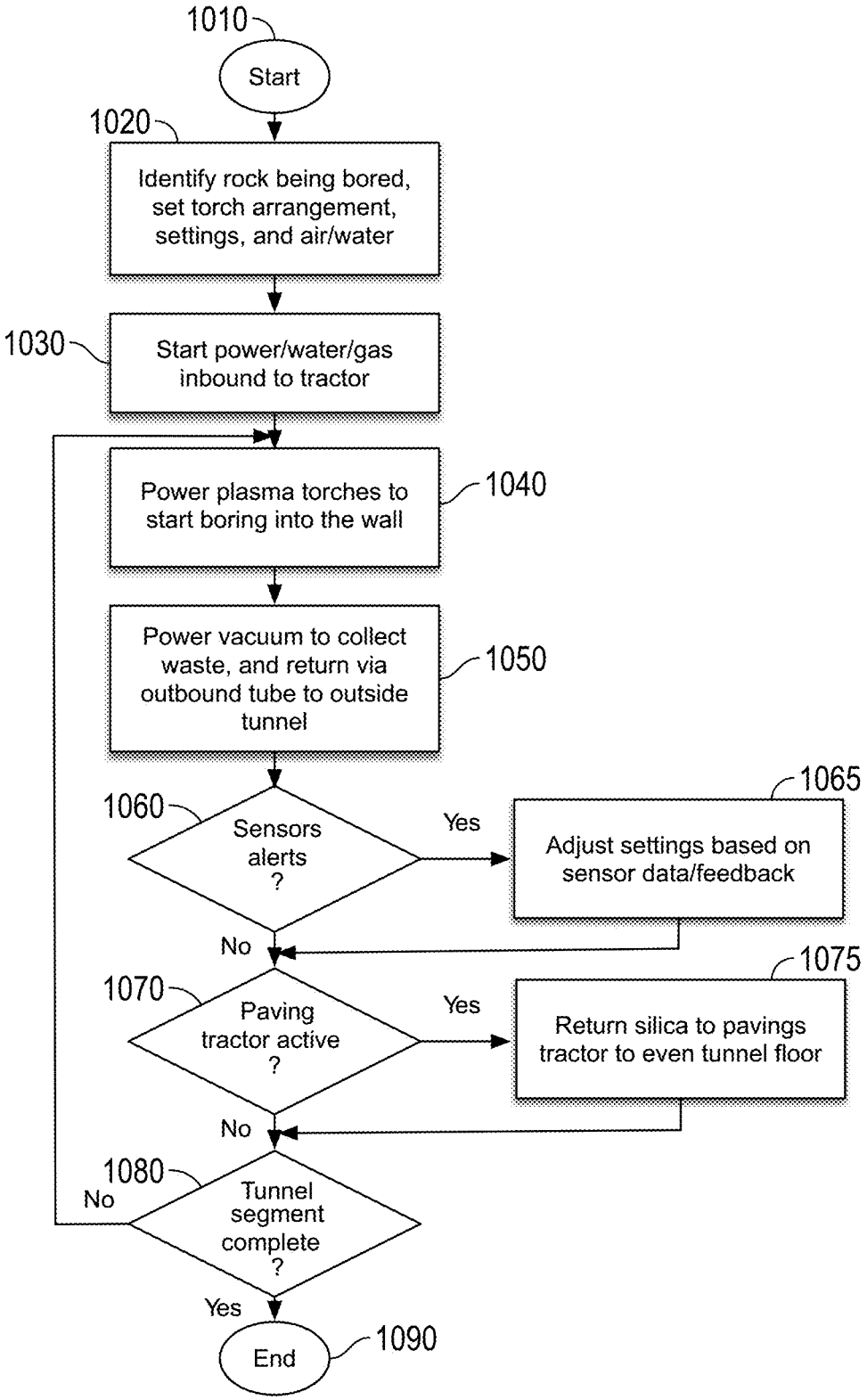
FIG. 10 is a flowchart of one embodiment of using the tunnel boring system.

FIG. 10 is a flowchart of one embodiment of using the tunnel boring system. The process starts at block 1010.

At block 1020, the rock being bored is identified. The torch arrangement is selected based on the rock, as are the torch settings. In one embodiment, the torch arrangement defines the size and position of the torches used, as well as their spacing. The torch settings, in one embodiment, include the power level used. The air and/or water stream and stand-off distance are also selected, based on the rock composition and the torch arrangement and settings. The air and/or water stream is selected based on the rock composition. Some rocks are best split with a steady air stream, and some do not need that.

At block 1030, the power/water/air inbound is started to the tractor. As noted above, there is an umbilical which in one embodiment stretches to the entrance of the tunnel.

At block 1040, the plasma torches are powered, to start boring. In one embodiment, the air/water/steam stream is also started.

At block 1050, the vacuum is powered to collect the waste from the boring, and return it to the tunnel entrance via an outbound tube. In one embodiment, the vacuum includes multiple intakes.

At block 1060, the process determines whether any of the sensors within the tunnel are alerting. If so, at block 1065, the alert is addressed. The alerts may be for sensors indicating a potential gas leak. In that instance, the remediation may be to turn off the plasma torches, add water to the process, or some other solution. In one embodiment, the sensor may alert if the drilling speed is not as expected. The sensor data may be used to adjust the arrangement or settings of the torches, the presence of absence of the air, water, or steam stream, etc. The process then returns to block 1070.

At block 1070 the process determines whether the paving tractor is active. In one embodiment, the paving tractor is optional. If it is active, at block 1075, the return of silica waste is initiated to the paving tractor, and the paving tractor applies the silica and air jet to the tunnel floor and melts it via a plasma torch directed at the ground.

At block 1080, the process determines whether the tunnel segment is complete, or the boring should be stopped for another reason. If not, the process returns to block 1040 to continue drilling. If the process is over, it ends at block 1090. In one embodiment, the process may be paused and restarted as needed.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

I claim:

1. A tunnel boring machine comprising:

a cutting head;

a plurality of plasma torches on the cutting head;

a plurality of nozzles on the cutting head to provide a stream to cool an area while the plasma torches are active;

one or more vacuum tubes to vacuum up spoils generated by the cutting head, the one or more vacuum tubes are lined with a cooling sleeve circulating chilled water to cool the spoils; and a tractor providing propulsion to the cutting head, the tractor to move the cutting head to cut a tunnel.

2. The machine of claim 1, wherein the cutting head has a horseshoe shape, with a flat bottom and a curved top.

3. The machine of claim 1, further comprising:

a chiller to chill the stream, to create a greater temperature delta between a heat of the plasma torches and the stream.

4. The machine of claim 1, wherein the nozzles comprise a high pressure air jet nozzle to direct a stream of air.

5. The machine of claim 1, wherein at least one of the nozzles comprises a high pressure water jet nozzle to direct the stream.

6. The machine of claim 5, wherein the stream comprises one of: water and steam.

7. The machine of claim 1, further comprising:

a plurality of power units for the plasma torches, wherein a subset of the plasma torches are powered by each of the plurality of power units.

8. The machine of claim 7, wherein the subset of the plasma torches powered by a power unit are not adjacent to each other.

9. The machine of claim 1, further comprising:

a vacuum inlet at a base of the cutting head to vacuum remove spoils.

10. The machine of claim 1, further comprising:

a plurality of vacuum inlets;

a metal tube to combine vacuum streams from the vacuum inlets to create a stream of spoils from the tunnel.

11. The machine of claim 1, further comprising:

a vacuum cart behind the tractor to remove the spoils generated by the cutting head.

12. The machine of claim 1, further comprising:

rapid start/stop-valves for at least a subset of the plurality of nozzles to create agitation to overcome particle inertia.

13. The machine of claim 1, further comprising:

a paving tractor pulled by the tractor, the paving tractor to apply material to one or more of: a roof of the tunnel, walls of the tunnel, and/or a bottom of the tunnel.

14. The machine of claim 1, further comprising:

an adjustable arm to connect the cutting head to the tractor, to boom and swing the cutting head, enabling the tunnel boring machine to change an angle of the tunnel being bored.

15. The machine of claim 1, wherein the cutting head further comprises:

a concave shield to reflect energy output by the plasma torches towards a cutting face, to assist a boring rate of penetration.

16. The machine of claim 1, wherein plumes of the plasma torches overlap, and the overlap creates a synergy to increase thermal and kinetic energy applied to a boring surface.

17. A tunnel boring machine including a cutting head, the machine comprising:

a plurality of plasma torches on the cutting head, the cutting head having a horseshoe shape, with a flat bottom and a curved top;

a plurality of vacuum inlets to vacuum up spoils generated by the cutting head;

a metal tube to combine vacuum streams from the vacuum inlets to create a stream of spoils from the tunnel; and a tractor providing propulsion to the cutting head, the tractor to move the cutting head to cut a tunnel.

18. The machine of claim 17, further comprising a plurality of nozzles on the cutting head to provide a stream to cool an area while the plasma torches are active.

19. The machine of claim 18, wherein the stream comprises one or more of: cold air, cold water, and a combination of cold air and cold water.

20. A tunnel boring machine comprising:

a cutting head including a plurality of plasma torches and a plurality of nozzles to provide a stream to cool an area while the plasma torches are active;

a tractor providing propulsion to the cutting head, the tractor to move the cutting head to cut a tunnel;

a plurality of vacuum inlets to vacuum up spoils generated by the cutting head; and a metal tube to combine vacuum streams from the plurality of vacuum inlets to create a stream of spoils from the tunnel.

21. A tunnel boring machine comprising:

a cutting head including a plurality of plasma torches and a plurality of nozzles to provide a stream to cool an area while the plasma torches are active;

a tractor providing propulsion to the cutting head, the tractor to move the cutting head to cut a tunnel; and a paving tractor pulled by the tractor, the paving tractor to apply material to one or more of: a roof of the tunnel, walls of the tunnel, and/or a bottom of the tunnel.

* * * * *